US011302340B2

(12) United States Patent
Kamamoto et al.

(10) Patent No.: US 11,302,340 B2
(45) Date of Patent: Apr. 12, 2022

(54) PITCH EMPHASIS APPARATUS, METHOD AND PROGRAM FOR THE SAME

(71) Applicant: NIPPON TELEGRAPH AND TELEPHONE CORPORATION, Tokyo (JP)

(72) Inventors: Yutaka Kamamoto, Tokyo (JP); Ryosuke Sugiura, Tokyo (JP); Takehiro Moriya, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 0 days.

(21) Appl. No.: 17/053,711

(22) PCT Filed: Apr. 23, 2019

(86) PCT No.: PCT/JP2019/017155
§ 371 (c)(1),
(2) Date: Nov. 6, 2020

(87) PCT Pub. No.: WO2019/216192
PCT Pub. Date: Nov. 14, 2019

(65) Prior Publication Data

US 2021/0090586 A1 Mar. 25, 2021

(30) Foreign Application Priority Data

May 10, 2018 (JP) ..... JP2018-091201

(51) Int. Cl.
*G10L 21/013* (2013.01)
*G10L 21/034* (2013.01)
*G10L 21/0364* (2013.01)

(52) U.S. Cl.
CPC ..... *G10L 21/013* (2013.01); *G10L 21/034* (2013.01); *G10L 21/0364* (2013.01)

(58) Field of Classification Search
CPC ..... G10L 21/013; G10L 21/0364
See application file for complete search history.

(56) References Cited

U.S. PATENT DOCUMENTS 6,078,881 A * 6/2000 Ota ..... G10L 19/08 704/222
6,141,638 A * 10/2000 Peng ..... G10L 19/10 704/211

(Continued)

FOREIGN PATENT DOCUMENTS

JP H10-143195 A 5/1998

OTHER PUBLICATIONS

International Telecommunication Union (2006) "Dual rate speech coder for multimedia communications transmitting at 5.3 and 6.3 kbit/s," ITU-T Recommendation G.723.1 (May 2006) pp. 16-18.

*Primary Examiner* — Shaun Roberts

(57) ABSTRACT

Provided is pitch enhancement processing having little unnaturalness even in time segments for consonants, and having little unnaturalness to listeners caused by discontinuities even when time segments for consonants and other time segments switch frequently. A pitch emphasis apparatus obtains an output signal by executing pitch enhancement processing on each of time segments of a signal originating from an input audio signal. The pitch emphasis apparatus includes a pitch enhancing unit that carries out the following as the pitch enhancement processing: obtaining an output signal for each of times n in each of the time segments, the output signal being a signal including a signal obtained by adding (1) a signal obtained by multiplying the signal of a time further in the past than the time n by a number of samples T0 corresponding to a pitch period of the time segment for the time n, η-th power of a pitch gain σ0 of the (Continued)

time segment, and a predetermined constant B0, to (2) the signal of the time n, η being a value greater than 1.

5 Claims, 4 Drawing Sheets

(56) References Cited

U.S. PATENT DOCUMENTS 7,065,485 B1* 6/2006 Chong-White ..... G10L 21/04 704/200.1
9,190,066 B2* 11/2015 Gao ..... G10L 19/12
2002/0103638 A1* 8/2002 Gao ..... G10L 21/0364 704/207
2002/0128829 A1* 9/2002 Yamaura ..... G10L 19/12 704/223
2003/0074192 A1* 4/2003 Choi ..... G10L 25/90 704/219
2005/0165608 A1* 7/2005 Suzuki ..... G10L 19/06 704/261
2009/0061785 A1* 3/2009 Kawashima ..... G10L 19/005 455/69
2009/0287481 A1* 11/2009 Paranjpe ..... G10L 21/02 704/226
2009/0306971 A1* 12/2009 Kim ..... G10L 21/0364 704/203
2011/0295598 A1* 12/2011 Yang ..... G10L 21/038 704/205
2012/0296659 A1* 11/2012 Oshikiri ..... G10L 19/24 704/500
2016/0111094 A1* 4/2016 Lecomte ..... G10L 19/12 704/207

* cited by examiner

PITCH EMPHASIS APPARATUS, METHOD AND PROGRAM FOR THE SAME

CROSS-REFERENCE TO RELATED APPLICATIONS

This application is a U.S. 371 Application of International Patent Application No. PCT/JP2019/017155, filed on 23 Apr. 2019, which application claims priority to and the benefit of JP Application No. 2018-091201, filed on 10 May 2018, the disclosures of which are hereby incorporated herein by reference in their entireties.

TECHNICAL FIELD

This invention relates to analyzing and enhancing a pitch component of a sample sequence originating from an audio signal, in a signal processing technique such as an audio signal encoding technique.

BACKGROUND ART

Typically, when a sample sequence such as a time-series signal is subjected to lossy coding, the sample sequence obtained during decoding is a distorted sample sequence and is thus different from the original sample sequence. When coding audio signals in particular, the distortion often contains patterns not found in natural sounds, and the decoded audio signal may therefore feel unnatural to listeners. As such, focusing on the fact that many natural sounds contain periodic components based on sound when observed in a set section, i.e., contain a pitch, techniques which convert an audio signal to more natural sound by carrying out processing for enhancing a pitch component are commonly used, where an amount of past samples equivalent to the pitch period is added for each sample in an audio signal obtained from decoding. (e.g., Non-patent Literature 1).

There are also techniques such as that described in Patent Literature 1, for example, where based on information indicating whether an audio signal obtained from decoding is "voice" or "not voice", processing for enhancing a pitch component is carried out when the audio signal is "voice", whereas the processing for enhancing a pitch component is not carried out when the audio signal is "not voice".

CITATION LIST

Non-Patent Literature

[Non-patent Literature 1] ITU-T Recommendation G.723.1 (May/2006) pp. 16-18, 2006

PATENT LITERATURE

[Patent Literature 1] Japanese Patent Application Publication No. H10-143195

SUMMARY OF THE INVENTION

Technical Problem

However, the technique disclosed in Non-patent Literature 1 has a problem in that the processing for enhancing pitch components is carried out even on consonant parts which have no clear pitch structure, which results in those consonant parts sounding unnatural to listeners. On the other hand, the technique disclosed in Patent Literature 1 does not carry out any processing for enhancing pitch components, even when a pitch component is present as a signal in a consonant part, which results in those consonant parts sounding unnatural to listeners. The technique disclosed in Patent Literature 1 also has a problem in that whether or not the pitch enhancement processing is carried out switches between time segments for vowels and time segments for consonants, resulting in frequent discontinuities in the audio signal and increasing the sense of unnaturalness to listeners.

With the foregoing in view, an object of the present invention is to realize pitch enhancement processing having little unnaturalness even in time segments for consonants, and having little unnaturalness to listeners caused by discontinuities even when time segments for consonants and other time segments switch frequently. Note that consonants include fricatives, plosivs, semivowels, nasals, and affricates (see Reference Document 1 and Reference Document 2).

[Reference Document 1] Furui, S. *Acoustic and Audio Engineering*. Kindai Kagakusha, 1992, p. 99

[Reference Document 2] Saito, S. and Tanaka, K. *Fundamentals of Voice Information Processing*. Ohmsha, 1981, p. 38-39

Means for Solving the Problem

To solve the above-described problems, according to one aspect of the present invention, a pitch emphasis apparatus obtains an output signal by executing pitch enhancement processing on each of time segments of a signal originating from an input audio signal. The pitch emphasis apparatus includes a pitch enhancing unit that carries out the following as the pitch enhancement processing: obtaining an output signal for each of times n in each of the time segments, the output signal being a signal including a signal obtained by adding (1) a signal obtained by multiplying the signal of a time further in the past than the time n by a number of samples $T_0$ corresponding to a pitch period of the time segment for the time n, $\eta$-th power of a pitch gain $\sigma_0$ of the time segment, and a predetermined constant $B_0$, to (2) the signal of the time n, $\eta$ being a value greater than 1.

Effects of the Invention

The present invention makes it possible to achieve an effect of realizing pitch enhancement processing in which, when the pitch enhancement processing is executed on a voice signal obtained from decoding processing, there is little unnaturalness even in time segments for consonants, and there is little unnaturalness to listeners caused by discontinuities even when time segments for consonants and other time segments switch frequently.

DESCRIPTION OF EMBODIMENTS

Figure 1:
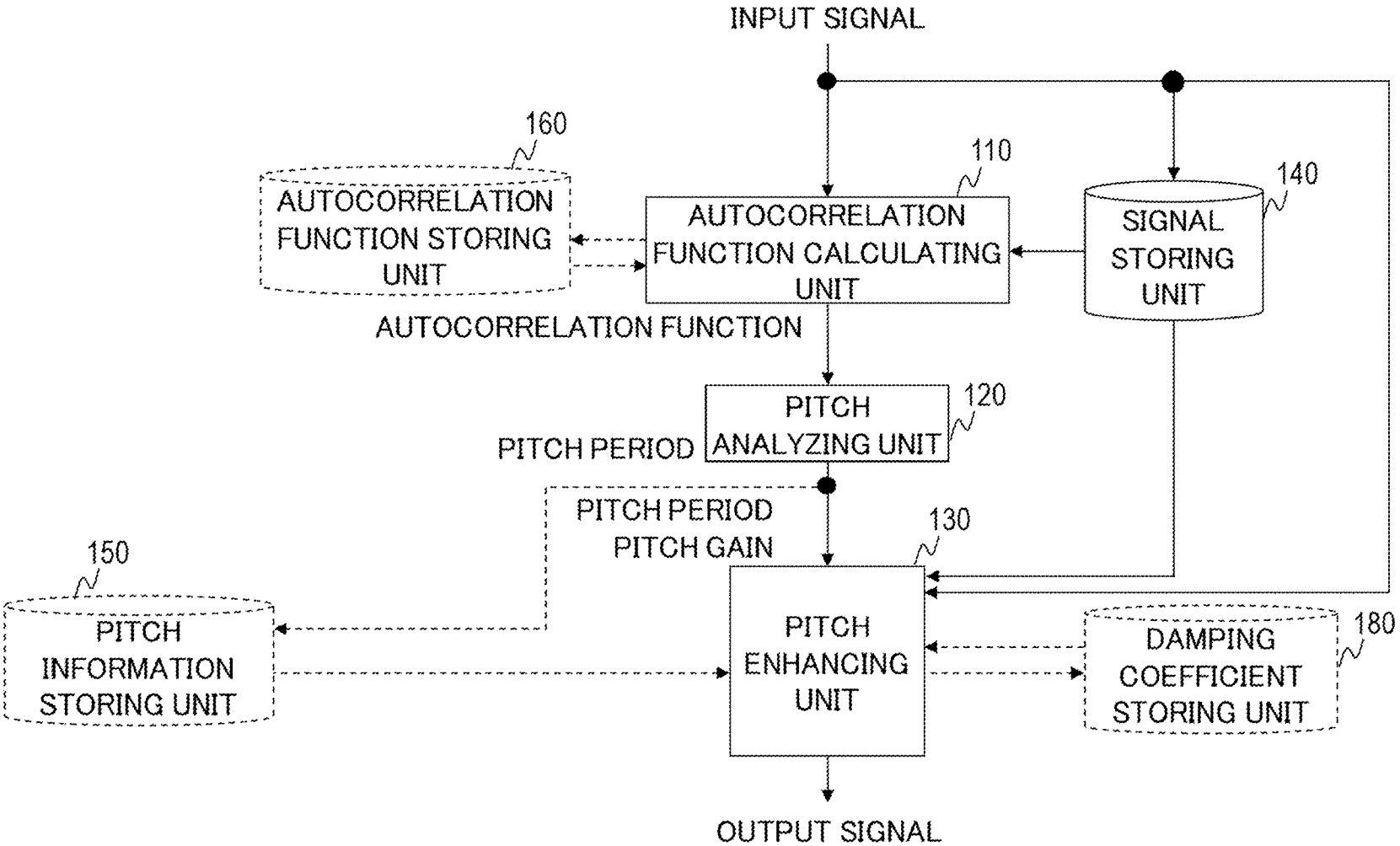
FIG. 1 is a function block diagram illustrating a pitch emphasis apparatus according to a first embodiment, a second embodiment, a third embodiment, and variations thereon.

Embodiments of the present invention will be described hereinafter. Note that in the drawings referred to in the following descriptions, constituent elements having the same functions, steps performing the same processing, and the like are given the same reference signs, and redundant descriptions thereof will not be given. Unless otherwise specified, the following descriptions assume that processing carried out in units of vectors, elements in matrices, and so on are applied to all of those vectors, elements in the matrices, and so on.

First Embodiment

Figure 2:
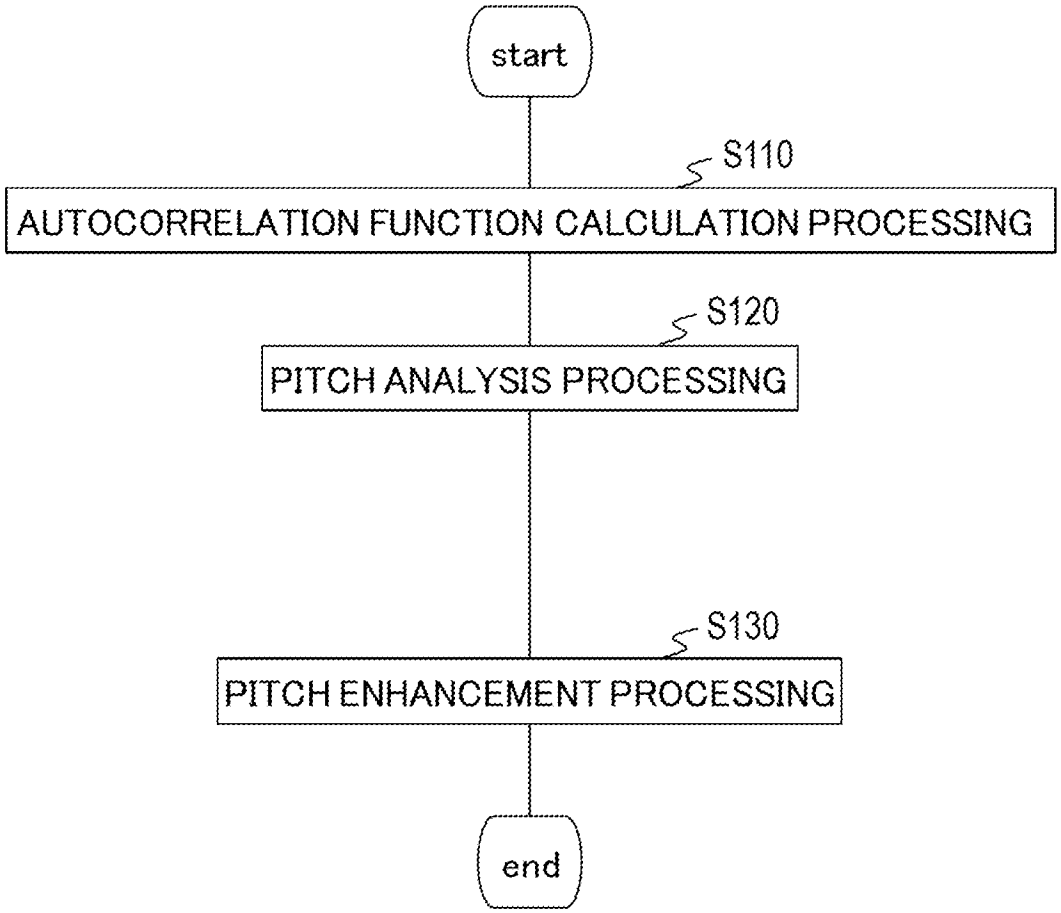
FIG. 2 is a diagram illustrating an example of a flow of processing by the pitch emphasis apparatus according to the first embodiment, the second embodiment, the third embodiment, and variations thereon.

FIG. 1 is a function block diagram illustrating a voice pitch emphasis apparatus according to a first embodiment, and FIG. 2 illustrates a flow of processing by the apparatus.

A processing sequence carried out by the voice pitch emphasis apparatus according to the first embodiment will be described with reference to FIG. 1. The voice pitch emphasis apparatus according to the first embodiment analyzes a signal to obtain a pitch period and a pitch gain, and then enhances the pitch on the basis of the pitch period and the pitch gain. In the present embodiment, when pitch enhancement processing is carried out on an input audio signal in each of time segments, using a result of multiplying a pitch component corresponding to the pitch period by the pitch gain, the pitch component is multiplied by $\eta$-th power of the pitch gain rather than by the pitch gain itself. Note that $\eta>1$. Consonants have a property of having a smaller periodicity than vowels, and thus a pitch gain obtained by analyzing an input signal will be a lower value for consonant time segments than for vowel time segments. Note that this pitch gain is normally a value less than 1, excluding exceptional cases. According to the present embodiment, to solve the above-described problems, by using this property and multiplying the pitch component by $\eta$-th power of the pitch gain rather than by the pitch gain itself, the degree of emphasis on pitch components in consonant time segments is reduced compared to that of vowel time segments.

The voice pitch emphasis apparatus according to the first embodiment includes an autocorrelation function calculating unit 110, a pitch analyzing unit 120, a pitch enhancing unit 130, and a signal storing unit 140, and may further include a pitch information storing unit 150, an autocorrelation function storing unit 160, and a damping coefficient storing unit 180.

The voice pitch emphasis apparatus is a special device configured by loading a special program into a common or proprietary computer having a central processing unit (CPU), a main storage device (RAM: random access memory), and the like, for example. The voice pitch emphasis apparatus executes various types of processing under the control of the central processing unit, for example. Data input to the voice pitch emphasis apparatus, data obtained from the various types of processing, and the like is stored in the main storage device, for example, and the data stored in the main storage device is read out to the central processing unit and used in other processing as necessary. The various processing units of the voice pitch emphasis apparatus may be at least partially constituted by hardware such as an integrated circuit or the like. The various storage units included in the voice pitch emphasis apparatus can be constituted by, for example, the main storage device such as RAM (random access memory), or by middleware such as relational databases, key value stores, and so on. However, the storage units do not absolutely have to be provided within the voice pitch emphasis apparatus, and may be constituted by auxiliary storage devices such as a hard disk, an optical disk, or a semiconductor memory device such as Flash memory, and provided outside the voice pitch emphasis apparatus.

The main processing carried out by the voice pitch emphasis apparatus according to the first embodiment is autocorrelation function calculation processing (S110), pitch analysis processing (S120), and pitch enhancement processing (S130) (see FIG. 2), and since these instances of processing are carried out by a plurality of hardware resources included in the voice pitch emphasis apparatus operating cooperatively, the autocorrelation function calculation processing (S110), the pitch analysis processing (S120), and the pitch enhancement processing (S130) will each be described hereinafter along with processing related thereto.

[Autocorrelation Function Calculation Processing (S110)]

First, the autocorrelation function calculation processing, and processing related thereto, carried out by the voice pitch emphasis apparatus, will be described.

A time-domain audio signal (an input signal) is input to the autocorrelation function calculating unit 110. The audio signal is a signal obtained by first encoding an acoustic signal such as a voice signal into code using a coding device, and then decoding the code using a decoding device corresponding to the coding device. A sample sequence of the time-domain audio signal from a current frame input to the voice pitch emphasis apparatus is input to the autocorrelation function calculating unit 110, in units of frames of a predetermined length of time (time segments). When a positive integer indicating the length of one frame's worth of the sample sequence is represented by N, N time-domain audio signal samples constituting the sample sequence of the time-domain audio signal in the current frame are input to the autocorrelation function calculating unit 110. The autocorrelation function calculating unit 110 calculates an autocorrelation function $R_0$ for a time difference 0 and autocorrelation functions $R_{\tau(1)}, \ldots, R_{\tau(M)}$ for each of a plurality of (M; M is a positive integer) predetermined time differences $\tau(1), \ldots, \tau(M)$, in a sample sequence constituted by the newest L audio signal samples (where L is a positive integer) including the input N time-domain audio signal samples. In other words, the autocorrelation function calculating unit 110 calculates an autocorrelation function for the sample sequence constituted by the newest audio signal samples including the time-domain audio signal samples in the current frame.

Note that in the following, the autocorrelation function calculated by the autocorrelation function calculating unit 110 in the processing for the current frame, i.e., the autocorrelation function for the sample sequence constituted by the newest audio signal samples including the time-domain audio signal samples in the current frame, will be called the "autocorrelation function of the current frame". Likewise, when a given past frame is taken as a frame F, the autocorrelation function calculated by the autocorrelation function calculating unit 110 in the processing of the frame F, i.e., the autocorrelation function for the sample sequence constituted by the newest audio signal samples at the point in time of the frame F, including the time-domain audio signal samples in the frame F, will be called the "autocorrelation function of the frame F". The "autocorrelation function" may also be called simply the "autocorrelation". To enable the use of the newest L audio signal samples in the autocorrelation function calculation when the value of L is greater than N, the voice pitch emphasis apparatus includes the signal storing unit 140, which makes it possible to store at least the newest L-N audio signal samples input up to one frame previous. Then, when the N time-domain audio signal samples in the current frame have been input, the autocorrelation function calculating unit 110 obtains the newest L audio signal samples $X_0, X_1, \ldots, X_{L-1}$ by reading out the newest L-N audio signal samples stored in the signal storing unit 140 as $X_0, X_1, \ldots, X_{L-N-1}$ and then taking the input N time-domain audio signal samples as $X_{L-N}, X_{L-N+1}, \ldots, X_{L-1}$.

Then, using the newest L audio signal samples $X_0, X_1, \ldots, X_{L-1}$, the autocorrelation function calculating unit 110 calculates the autocorrelation function $R_0$ of the time difference 0 and the autocorrelation functions $R_{\tau(1)}, \ldots, R_{\tau(M)}$ for the corresponding plurality of predetermined time differences $\tau(1), \ldots, \tau(M)$. When the time differences such as $\tau(1), \ldots, \tau(M)$ and 0 are represented by $\tau$, the autocorrelation function calculating unit 110 calculates the autocorrelation functions $R_\tau$ through the following Expression (1), for example.

[Formula 1]

$$R_\tau = \sum_{l=\tau}^{L-1} X_l X_{l-\tau} \tag{1}$$

The autocorrelation function calculating unit 110 outputs the calculated autocorrelation functions $R_0, R_{\tau(1)}, \ldots, R_{\tau(M)}$ to the pitch analyzing unit 120.

Note that these time differences $\tau(1), \ldots, \tau(M)$ are candidates for a pitch period $T_0$ in the current frame, found by the pitch analyzing unit 120, which will be described later. For example, assuming an audio signal constituted primarily by a voice signal with a sampling frequency of 32 kHz, an implementation such as where integer values from 75 to 320, which are favorable as candidates for the pitch period of voice, are taken as $\tau(1), \ldots, \tau(M)$ is conceivable. Note that instead of $R_\tau$ in Expression (1), a normalized autocorrelation function $R_\tau/R_0$ may be found by dividing $R_\tau$ in Expression (1) by $R_0$. However, if L is, for example, a value much higher than the candidates of 75 to 320 for the pitch period $T_0$, such as 8192, it is better to calculate the autocorrelation function $R_\tau$ through the method described below, which suppresses the amount of computations, than find the normalized autocorrelation function $R_\tau/R_0$ instead of the autocorrelation function $R_\tau$.

The autocorrelation function $R_\tau$ may be calculated using Expression (1) itself, or the same value as that found using Expression (1) may be calculated using another calculation method. For example, by providing the autocorrelation function storing unit 160 in the voice pitch emphasis apparatus, the autocorrelation functions $R_{\tau(1)}, \ldots, R_{\tau(M)}$ (the autocorrelation function for the frame immediately previous), obtained through the processing for calculating the autocorrelation function for one frame previous (the frame immediately previous), may be stored, and the autocorrelation function calculating unit 110 may calculate the autocorrelation functions $R_{\tau(1)}, \ldots, R_{\tau(M)}$ of the current frame by adding the extent of contribution of the newly-input audio signal sample of the current frame and subtracting the extent of contribution of the oldest frame for each of the autocorrelation functions $R_{\tau(1)}, \ldots, R_{\tau(M)}$ (the autocorrelation function for the frame immediately previous) obtained through the processing of the immediately-previous frame read out from the autocorrelation function storing unit 160. Accordingly, the amount of computations required to calculate the autocorrelation functions can be suppressed more than when using Expression (1) itself for the calculation. In this case, assuming that $\tau(1), \ldots, \tau(M)$ are each $\tau$, the autocorrelation function calculating unit 110 obtains the autocorrelation function $R_\tau$ of the current frame by adding a difference $Or^+$ obtained through the following Expression (2), and subtracting a difference $\Delta R_\tau^-$ obtained through the following Expression (3), to and from the autocorrelation function $R_\tau$ obtained in the processing of the frame immediately previous (the autocorrelation function $R_\tau$ of the frame immediately previous).

[Formula 2]

$$\Delta R_\tau^+ = \sum_{l=L-N}^{L-1} X_l X_{l-\tau} \tag{2}$$

$$\Delta R_\tau^- = \sum_{l=\tau}^{N-L+\tau} X_l X_{l-\tau} \tag{3}$$

Additionally, the amount of computations may be reduced by calculating the autocorrelation function through processing similar to that described above, but using a signal in which the number of samples has been reduced by downsampling the L audio signal samples, thinning the samples, or the like, rather than the newest L audio signal samples of the input signal themselves. In this case, the M time differences $\tau(1), \ldots, \tau(M)$ are expressed as, for example, half the number of samples, if the number of samples have been halved. For example, if the above-described 8192 audio signal samples at a sampling frequency of 32 kHz have been downsampled to 4096 samples at a sampling frequency of 16 kHz, $\tau(1), \ldots, \tau(M)$, which are the candidates for the pitch period T, may be set to 37 to 160, i.e., approximately half of 75 to 320.

After the voice pitch emphasis apparatus has completed processing up to that carried out by the pitch enhancing unit 130 (described later) for the current frame, the signal storing unit 140 updates the stored content so that the newest L-N audio signal samples at that point in time are stored. Specifically, when, for example, L>2N, the signal storing unit 140 deletes the N oldest audio signal samples $X_0, X_1, \ldots, X_{N-1}$ among the L-N audio signal samples which are stored, takes $X_N, X_{N+1}, \ldots, X_{L-N-1}$ as $X_0, X_1, \ldots, X_{L-2N-1}$, and newly stores the N time-domain audio signal samples of the current frame, which have been input, as $X_{L-2N}, X_{L-2N+1}, \ldots, X_{L-N-1}$. When L≤2N, the signal storing unit 140 deletes the L-N audio signal samples $X_0, X_1, \ldots, X_{L-N-1}$ which are stored, and then newly stores the newest L-N audio signal samples, among the N time-domain audio signal samples in the current frame which have been input, as $X_0, X_1, \ldots, X_{L-N-1}$. Note that the signal storing unit 140 need not be provided in the voice pitch emphasis apparatus when L≤N.

Additionally, after the autocorrelation function calculating unit 110 has finished calculating the autocorrelation functions for the current frame, the autocorrelation function storing unit 160 updates the stored content so as to store the calculated autocorrelation functions $R_{\tau(1)}, \ldots, R_{\tau(M)}$ of the current frame. Specifically, the autocorrelation function storing unit 160 deletes $R_{\tau(1)}, \ldots, R_{\tau(M)}$ which are stored, and newly stores the calculated autocorrelation functions $R_{\tau(1)}, \ldots, R_{\tau(M)}$ of the current frame.

Although the foregoing descriptions assume that the newest L audio signal samples include the N audio signal samples of the current frame (i.e., that L is greater than or equal to N), L does not absolutely have to be greater than or equal to N, and L may be less than N. In this case, the autocorrelation function calculating unit 110 may calculate the autocorrelation function $R_0$ of the time difference 0 and the autocorrelation functions $R_{\tau(1)}, \ldots, R_{\tau(M)}$ for the corresponding plurality of predetermined time differences $\tau(1), \ldots, \tau(M)$ using L consecutive audio signal samples $X_0, X_1, \ldots, X_{L-1}$ included in the N of the current frame.

[Pitch Analysis Processing (S120)]

The pitch analysis processing carried out by the voice pitch emphasis apparatus will be described next.

The autocorrelation functions $R_0, R_{\tau(1)}, \ldots, R_{\tau(M)}$ of the current frame, output by the autocorrelation function calculating unit 110, are input to the pitch analyzing unit 120.

The pitch analyzing unit 120 finds a maximum value among the autocorrelation functions $R_{\tau(1)}, \ldots, R_{\tau(M)}$ of the current frame with respect to the predetermined time difference, obtains a ratio of the maximum value of the autocorrelation functions to the autocorrelation function $R_0$ for the time difference 0 as the pitch gain $\sigma_0$ of the current frame, obtains a time difference at which the autocorrelation function is the maximum value as the pitch period $T_0$ of the current frame, and outputs the pitch gain $\sigma_0$ and the pitch period $T_0$ to the pitch enhancing unit 130.

[Pitch Enhancement Processing (S130)]

The pitch enhancement processing carried out by the voice pitch emphasis apparatus will be described next.

The pitch enhancing unit 130 receives the pitch period and pitch gain output by the pitch analyzing unit 120, and the time-domain audio signal of the current frame (the input signal) input to the voice pitch emphasis apparatus. Then, for the audio signal sample sequence of the current frame, the pitch enhancing unit 130 outputs an output signal sample sequence obtained by emphasizing the pitch component corresponding to the pitch period $T_0$ of the current frame at a degree of emphasis proportional to $\eta$-th power (where $\eta>1$) of the pitch gain $\sigma_0$.

A specific example will be described hereinafter.

The pitch enhancing unit 130 carries out the pitch enhancement processing on a sample sequence of the audio signal in the current frame, using the input pitch gain $\sigma_0$ of the current frame and the input pitch period $T_0$ of the current frame. Specifically, by obtaining an output signal $X^{new}_n$ through the following Expression (4) for each sample $X_n$ ($L-N \le n \le L-1$) constituting the input sample sequence of the audio signal in the current frame, the pitch enhancing unit 130 obtains a sample sequence of the output signal in the current frame constituted by N samples $X^{new}_{L-N}, \ldots, X^{new}_{L-1}$.

[Formula 3]

$$X_n^{new} = \frac{1}{A}[X_n + B_0\sigma_0^{\eta}X_{n-T_0}] \tag{4}$$

Here, $\eta$ is a predetermined value greater than 1. Note that A in Equation (4) is an amplitude correction coefficient found through the following Equation (5).

[Formula 4]

$$A=\sqrt{1+B_0^2\sigma_0^{2\eta}} \tag{5}$$

$B_0$ is a predetermined value, and is ¾, for example. The pitch gain $\sigma_0$ is normally a value less than 1, excluding exceptional cases. If a value greater than 1 has been found, as an exceptional case, for the pitch gain $\sigma_0$, the pitch enhancement processing in the foregoing Equation (4) may be found having first replaced the pitch gain $\sigma_0$ with 1. Accordingly, the pitch enhancement processing according to Equation (4) is processing for enhancing the pitch component which takes into account the pitch gain as well as the pitch period, and is furthermore processing for enhancing the pitch component in which a lower degree of enhancement is used for the pitch component in a frame with a low pitch gain and for the pitch component in a frame with a high pitch gain.

In other words, for each of times n in a frame (a time segment), the pitch enhancing unit 130 does the following for the number of samples $T_0$ corresponding to the pitch period of a frame including the signal $X_n$. That is, a signal is obtained by multiplying a signal $X_{n-T_0}$ from a time $n-T_0$ further in the past than the time n, $\eta$-th power of the pitch gain $\sigma_0$ in that frame ($\sigma_0^{\eta}$), and the predetermined constant $B_0$ ($B_0\sigma_0^{\eta}X_{n-T_0}$); that signal is then added to the signal $X_n$ from the time n ($X_n+B_0\sigma_0^{\eta}X_{n-T_0}$), and a signal including that resulting signal is obtained as an output signal $X^{new}_n$.

This pitch enhancement processing achieves an effect of reducing a sense of unnaturalness even in consonant frames, and reducing a sense of unnaturalness even if consonant frames and non-consonant frames switch frequently and the degree of emphasis on the pitch component fluctuates from frame to frame.

[First Variation on Pitch Enhancement Processing (S130)]

A first variation on the pitch enhancement processing carried out by the voice pitch emphasis apparatus, and processing pertaining thereto, will be described next.

The voice pitch emphasis apparatus according to the first variation further includes the pitch information storing unit 150.

The pitch enhancing unit 130 receives the pitch period and pitch gain output by the pitch analyzing unit 120, and the time-domain audio signal of the current frame (the input signal) input to the voice pitch emphasis apparatus. Then the pitch enhancing unit 130 outputs a sample sequence of an output signal obtained by enhancing the pitch component corresponding to the pitch period $T_0$ of the current frame and the pitch component corresponding to the pitch period of a past frame, with respect to the audio signal sample sequence of the current frame. At this time, the pitch component corresponding to the pitch period $T_0$ of the current frame is enhanced in a degree of enhancement proportional to $\eta$-th power ($\eta>1$) of the pitch gain $\sigma_0$ of the current frame. Note that in the following descriptions, the pitch period and pitch gain of a frame s frames previous to the current frame (s frames in the past) will be indicated as $T_{-s}$ and $\sigma_{-s}$, respectively.

Pitch periods $T_{-1}, \ldots, T_{-\alpha}$ and pitch gains $\sigma_{-1}, \ldots, \sigma_{-\alpha}$ from the previous frame to $\alpha$ frames in the past are stored in the pitch information storing unit 150. Here, $\alpha$ is a predetermined positive integer, and is 1, for example.

The pitch enhancing unit 130 carries out the pitch enhancement processing on the sample sequence of the audio signal in the current frame using the input pitch gain $\sigma_0$ of the current frame; the pitch gain $\sigma_{-\alpha}$ of the frame $\alpha$ frames in the past, read out from the pitch information storing unit 150; the input pitch period $T_0$ of the current frame; and the pitch period $T_{-\alpha}$ of the frame $\alpha$ frames in the past, read out from the pitch information storing unit 150.

A specific example will be described hereinafter.

Specific Example 1 of First Variation on Pitch Enhancement Processing

Specific Example 1 is an example in which the pitch component corresponding to the pitch period $T_0$ of the current frame is emphasized at a degree of emphasis proportional to $\eta$-th power (where $\eta>1$) of the pitch gain $\sigma_0$ of the current frame, and the pitch component corresponding to a pitch period $T_{-\alpha}$ of a frame $\alpha$ frames in the past is emphasized at a degree of emphasis proportional to a pitch gain $\sigma_{-\alpha}$ of the frame $\alpha$ frames in the past.

That is, in this specific example, by obtaining the output signal $X^{new}_n$ through the following Expression (6) for each sample $X_n$ ($L-N \le n \le L-1$) constituting the input sample sequence of the audio signal in the current frame, the pitch enhancing unit 130 obtains a sample sequence of the output signal in the current frame constituted by N samples $X^{new}_{L-N}, \ldots, X^{new}_{L-1}$.

[Formula 5]

$$X_n^{new} = \frac{1}{A}[X_n + B_0\sigma_0^{\eta}X_{n-T_0} + B_{-\alpha}\sigma_{-\alpha}X_{n-\tau_{-\alpha}}] \tag{6}$$

Note that A in Expression (6) is an amplitude correction coefficient found through the following Expression (7).

[Formula 6]

$$A=\sqrt{1+B_0^2\sigma_0^{2\eta}+B_{-\alpha}^2\sigma_{-\alpha}^2+2B_0B_{-\alpha}\sigma_0^{\eta}\sigma_{-\alpha}} \tag{7}$$

$B_0$ and $B_{-\alpha}$ are predetermined values less than 1, and are ¾ and ¼, for example.

Specific Example 2 of First Variation on Pitch Enhancement Processing

Specific Example 2 is an example in which the pitch component corresponding to the pitch period $T_0$ of the current frame is emphasized at a degree of emphasis proportional to $\eta$-th power (where $\eta>1$) the pitch gain $\sigma_0$ of the current frame, and the pitch component corresponding to a pitch period $T_{-\alpha}$ of a frame $\alpha$ frames in the past is emphasized at a degree of emphasis proportional to $\eta$-th power of a pitch gain $\sigma_{-\alpha}$ of the frame $\alpha$ frames in the past.

That is, in this specific example, by obtaining the output signal $X^{new}_n$ through the following Expression (8) for each sample $X_n$ ($L-N \le n \le L-1$) constituting the input sample sequence of the audio signal in the current frame, the pitch enhancing unit 130 obtains a sample sequence of the output signal in the current frame constituted by N samples $X^{new}_{L-N}, \ldots, X^{new}_{L-1}$.

[Formula 7]

$$X_n^{new} = \frac{1}{A}[X_n + B_0\sigma_0^{\eta}X_{n-T_0} + B_{-\alpha}\sigma_{-\alpha}^{\eta}X_{n-T_{-\alpha}}] \tag{8}$$

Note that A in Expression (8) is an amplitude correction coefficient found through the following Expression (9).

[Formula 8]

$$A=\sqrt{1+B_0^2\sigma_0^{2\eta}+B_{-\alpha}^2\sigma_{-\alpha}^{2\eta}+2B_0B_{-\alpha}\sigma_0^{\eta}\sigma_{-\alpha}^{\eta}} \tag{9}$$

$B_0$ and $B_{-\alpha}$ are predetermined values less than 1, and are ¾ and ¼, for example.

The pitch enhancement processing according to the first variation is a processing for enhancing the pitch component which takes into account the pitch gain as well as the pitch period, a processing for enhancing the pitch component in which a lower degree of enhancement is used for the pitch component with a small pitch gain than for the pitch component with a large pitch gain, and a processing for enhancing the pitch component corresponding to the pitch period $T_0$ of the current frame, while also enhancing the pitch component corresponding to the pitch period $T_{-\alpha}$ of a past frame with a slightly lower degree of enhancement than that of the pitch component corresponding to the pitch period $T_0$ of the current frame. The pitch enhancement processing according to the first variation can also achieve an effect in which even if the pitch enhancement processing is executed for each of short time segments (frames), discontinuities produced by fluctuations in the pitch period from frame to frame are reduced.

Note that in Equations (6) and (8), it is preferable that $B_0>B_{-\alpha}$. However, the effect of reducing discontinuities produced by fluctuations in the pitch period from frame to frame is achieved even if $B_0 \le B_{-\alpha}$ in Equations (6) and (8).

Additionally, the amplitude correction coefficient A found through Equations (7) and (9) is for ensuring that the energy of the pitch component is maintained between before and after the pitch enhancement, assuming that the pitch period $T_0$ of the current frame and the pitch period T-a of the frame $\alpha$ frames in the past are sufficiently close values.

Note that the pitch information storing unit 150 updates the stored content so that the pitch period and pitch gain of the current frame can be used as the pitch period and pitch gain of past frames when the pitch enhancing unit 130 processes subsequent frames.

[Second Variation on Pitch Enhancement Processing (S130)]

According to the first variation, a sample sequence of an output signal in which the pitch component corresponding to the pitch period $T_0$ of the current frame and the pitch component corresponding to a pitch period of a single frame in the past are enhanced, with respect to the audio signal sample sequence of the current frame. However, the pitch components corresponding to the pitch periods of a plurality of (two or more) past frames may be enhanced. The following will describe an example of enhancing pitch components corresponding to the pitch periods of two past frames as an example of enhancing the pitch components corresponding to the pitch periods of a plurality of past frames, focusing on points different from the first variation.

Pitch periods $T_{-1}, \ldots, T_{-\alpha}, \ldots, T_{-\beta}$ and pitch gains $\sigma_{-1}, \ldots, \sigma_{-\alpha}, \ldots, \sigma_{-\beta}$ from the current frame to $\beta$ frames in the past are stored in the pitch information storing unit 150. Here, $\beta$ is a predetermined positive integer greater than $\alpha$. For example, $\alpha$ is 1 and $\beta$ is 2.

The pitch enhancing unit 130 carries out the pitch enhancement processing on the sample sequence of the audio signal in the current frame using the input pitch gain $\sigma_0$ of the current frame; the pitch gain $\sigma_{-\alpha}$ of the frame $\alpha$ frames in the past, read out from the pitch information storing unit 150; the pitch gain $\sigma_{-\beta}$ of the frame $\beta$ frames in the past, read out from the pitch information storing unit 150; the input pitch period $T_0$ of the current frame; the pitch period $T_{-\alpha}$ of the frame $\alpha$ frames in the past, read out from the pitch information storing unit 150; and the pitch period $T_{-\beta}$ of the frame $\beta$ frames in the past, read out from the pitch information storing unit 150.

A specific example will be described hereinafter.

Specific Example 1 of Second Variation on Pitch Enhancement Processing

Specific Example 1 is an example in which the pitch component corresponding to the pitch period $T_0$ of the current frame is emphasized at a degree of emphasis proportional to η-th power (where η>1) of the pitch gain $\sigma_0$ of the current frame, the pitch component corresponding to a pitch period $T_{-\alpha}$ of a frame α frames in the past is emphasized at a degree of emphasis proportional to a pitch gain $\sigma_{-\alpha}$ of the frame α frames in the past, and the pitch component corresponding to a pitch period $T_{-\beta}$ of a frame β frames in the past is emphasized at a degree of emphasis proportional to a pitch gain $\sigma_{-\beta}$ of the frame β frames in the past.

That is, in this specific example, by obtaining the output signal $X^{new}_n$ through the following Expression (10) for each sample $X_n$ ($L-N \le n \le L-1$) constituting the input sample sequence of the audio signal in the current frame, the pitch enhancing unit 130 obtains a sample sequence of the output signal in the current frame constituted by N samples $X^{new}_{L-N}, \ldots, X^{new}_{L-1}$.

[Formula 9]

$$X_n^{new} = \frac{1}{A}\left[X_n + B_0\sigma_0^{\eta}X_{n-T_0} + B_{-\alpha}\sigma_{-\alpha}X_{n-T_{-\alpha}} + B_{-\beta}\sigma_{-\beta}X_{n-T_{-\beta}}\right] \tag{10}$$

Note that A in Expression (10) is an amplitude correction coefficient found through the following Expression (11).

[Formula 10]

$$A=\sqrt{1+B_0^2\sigma_0^{2\eta}+B_{-\alpha}^2\sigma_{-\alpha}^2+B_{-\beta}^2\sigma_{-\beta}^2+E+F+G} \tag{11}$$

where $E=2B_0B_{-\alpha}\sigma_0^{\eta}\sigma_{-\alpha}$ $F=2B_0B_{-\beta}\sigma_0^{\eta}\sigma_{-\beta}$ $G=2B_{-\alpha}B_{-\beta}\sigma_{-\alpha}\sigma_{-\beta}$ $B_0$, $B_{-\alpha}$, and $B_{-\beta}$ are predetermined values less than 1, and are ¾, 3/16, and 1/16, for example.

Specific Example 2 of Second Variation on Pitch Enhancement Processing

Specific Example 2 is an example in which the pitch component corresponding to the pitch period $T_0$ of the current frame is emphasized at a degree of emphasis proportional to η-th power (where η>1) of the pitch gain $\sigma_0$ of the current frame, the pitch component corresponding to a pitch period $T_{-\alpha}$ of a frame α frames in the past is emphasized at a degree of emphasis proportional to η-th power of a pitch gain $\sigma_{-\alpha}$ of the frame α frames in the past, and the pitch component corresponding to a pitch period $T_{-\beta}$ of a frame β frames in the past is emphasized at a degree of emphasis proportional to η-th power of a pitch gain $\sigma_{-\beta}$ of the frame β frames in the past.

That is, in this specific example, by obtaining the output signal $X^{new}_n$ through the following Expression (12) for each sample $X_n$ ($L-N \le n \le L-1$) constituting the input sample sequence of the audio signal in the current frame, the pitch enhancing unit 130 obtains a sample sequence of the output signal in the current frame constituted by N samples $X^{new}_{L-N}, \ldots, X^{new}_{L-1}$.

[Formula 11]

$$X_n^{new} = \frac{1}{A}\left[X_n + B_0\sigma_0^{\eta}X_{n-T_0} + B_{-\alpha}\sigma_{-\alpha}^{\eta}X_{n-T_{-\alpha}} + B_{-\beta}\sigma_{-\beta}^{\eta}X_{n-T_{-\beta}}\right] \tag{12}$$

Note that A in Expression (12) is an amplitude correction coefficient found through the following Expression (13).

[Formula 12]

$$A=\sqrt{1+B_0^2\sigma_0^{2\eta}+B_{-\alpha}^2\sigma_{-\alpha}^{2\eta}+B_{-\beta}^2\sigma_{-\beta}^{2\eta}+E+F+G} \tag{13}$$

where $E=2B_0B_{-\alpha}\sigma_0^{\eta}\sigma_{-\alpha}^{\eta}$ $F=2B_0B_{-\beta}\sigma_0^{\eta}\sigma_{-\beta}^{\eta}$ $G=2B_{-\alpha}B_{-\beta}\sigma_{-\alpha}^{\eta}\sigma_{-\beta}^{\eta}$ $B_0$, $B_{-\alpha}$, and $B_{-\beta}$ are predetermined values less than 1, and are ¾, 3/16, and 1/16, for example.

Like the pitch enhancement processing according to the first variation, the pitch enhancement processing according to the second variation is processing for enhancing the pitch component which takes into account the pitch gain as well as the pitch period, processing for enhancing the pitch component in which a lower degree of enhancement is used for the pitch component in consonant frames with a small pitch gain than for the pitch component in non-consonant frames with a large pitch gain, and processing for enhancing the pitch component corresponding to the pitch period $T_0$ of the current frame, while also enhancing the pitch component corresponding to the pitch period of a past frame with a slightly lower degree of enhancement than that of the pitch component corresponding to the pitch period $T_0$ of the current frame. The pitch enhancement processing according to the second variation can also achieve an effect in which even if the pitch enhancement processing is executed for each of short time segments (frames), discontinuities produced by fluctuations in the pitch period from frame to frame are reduced.

Note that in Equations (10) and (12), it is preferable that $B_0>B_{-\alpha}>B_{-\beta}$. However, the effect of reducing discontinuities produced by fluctuations in the pitch period from frame to frame is achieved even if $B_0 \le B_{-\alpha}$, $B_0 \le B_{-\beta}$, $B_{-\alpha} \le B_{-\beta}$, and so on in Equations (10) and (12).

Additionally, the amplitude correction coefficient A found through Equations (11) and (13) is for ensuring that the energy of the pitch component is maintained between before and after the pitch enhancement, assuming that the pitch period $T_0$ of the current frame, the pitch period $T_{-\alpha}$ of the frame α frames in the past, and the pitch period $T_{-\beta}$ of the frame β frames in the past are sufficiently close values.

(Other Variations on Pitch Enhancement Processing)

Note that one or more predetermined values may be used for the amplitude correction coefficient A, instead of the values found through Equations (5), (7), (9), (11), (11), and (13). When the amplitude correction coefficient A is 1, the pitch enhancing unit 130 may obtain the output signal $X^{new}_n$ through a Formula that does not include the term 1/A in the foregoing equations.

Additionally, instead of a value based on the sample previous by an amount equivalent to each pitch period, added to each sample of the input audio signal, a sample previous by an amount equivalent to each pitch period in an audio signal passed through a low-pass filter may be used, and processing equivalent to low-pass filtering may be carried out, for example.

Additionally, when the pitch gain is lower than a predetermined threshold, the pitch enhancement processing may be carried out without including that pitch component. For example, the configuration may be such that when the pitch gain $\sigma_0$ of the current frame is lower than a predetermined threshold, the pitch component corresponding to the pitch period $T_0$ of the current frame is not included in the output signal, and when the pitch gain of a past frame is lower than the predetermined threshold, the pitch component corresponding to the pitch period of that past frame is not included in the output signal.

OTHER EMBODIMENTS

Figure 3:
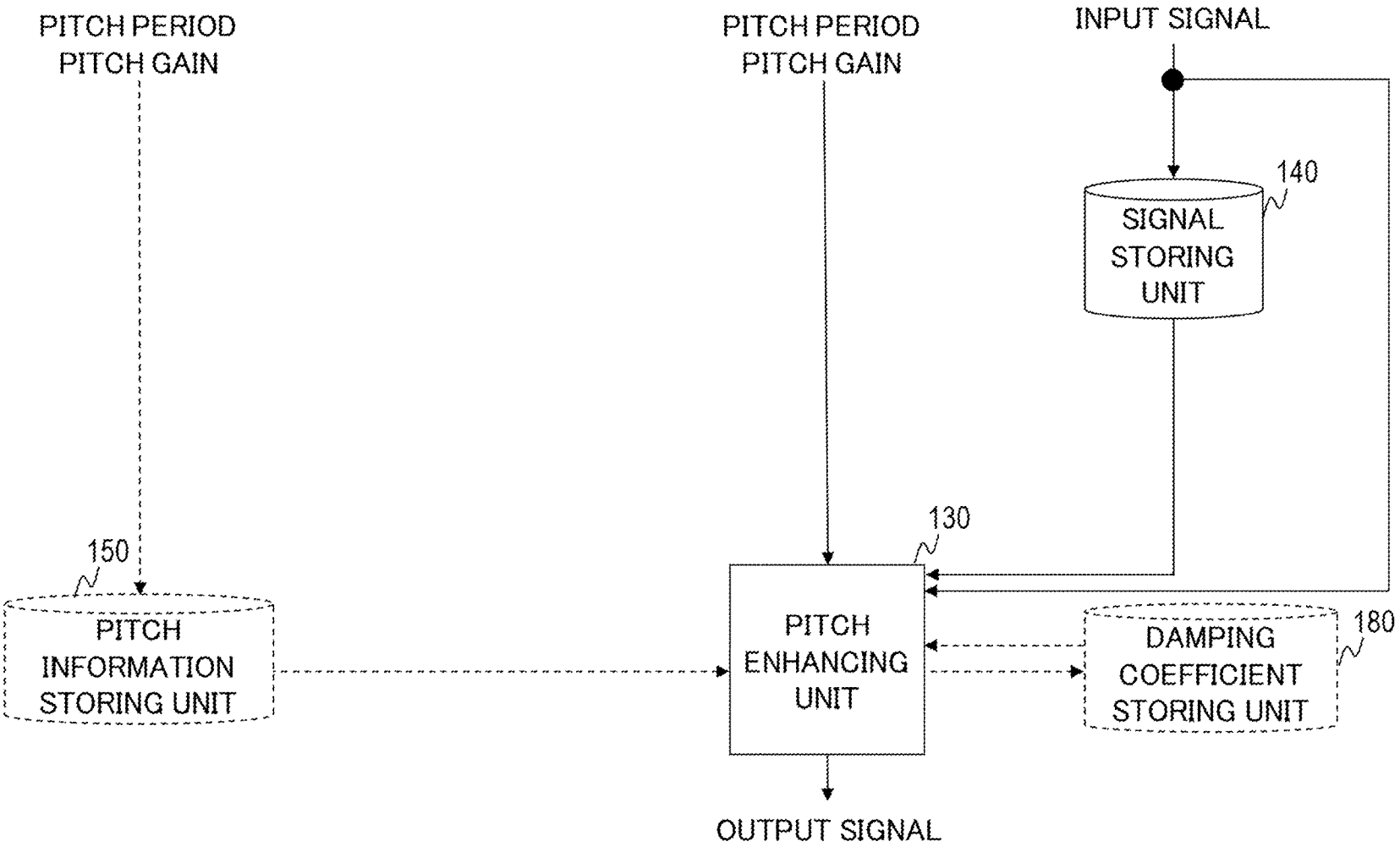
FIG. 3 is a function block diagram illustrating a pitch emphasis apparatus according to another variation.
Figure 4:
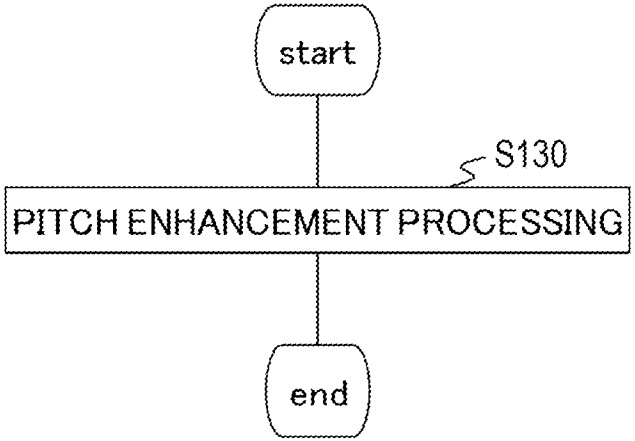
FIG. 4 is a diagram illustrating an example of a flow of processing by the pitch emphasis apparatus according to another variation.

When the pitch period and the pitch gain of each frame have been obtained through decoding processing or the like carried out outside the voice pitch emphasis apparatus, the voice pitch emphasis apparatus may employ the configuration illustrated in FIG. 3, and enhance the pitch on the basis of the pitch period and the pitch gain obtained outside the voice pitch emphasis apparatus. FIG. 4 illustrates a flow of processing in this case. In this example, it is not necessary to include the autocorrelation function calculating unit 110, the pitch analyzing unit 120, and the autocorrelation function storing unit 160 included in the voice pitch emphasis apparatus according to the first embodiment and the variations thereon; the pitch enhancing unit 130 may carry out the pitch enhancement processing (S130) using a pitch period and a pitch gain input to the voice pitch emphasis apparatus, instead of the pitch period and the pitch gain output by the pitch analyzing unit 120. By employing such a configuration, the amount of computational processing carried out by the voice pitch emphasis apparatus itself can be reduced as compared to the first embodiment and the variations thereon. However, the voice pitch emphasis apparatus according to the first embodiment and the variations thereon can obtain the pitch period and the pitch gain regardless of the frequency at which the pitch period and the pitch gain are obtained outside the voice pitch emphasis apparatus, and can therefore carry out the pitch enhancement processing in units of frames that are extremely short in terms of time. Using the above-described example of a sampling frequency of 32 kHz, assuming N is 32, for example, the pitch enhancement processing can be carried out in units of 1-ms frames.

Although the foregoing descriptions assume that the pitch enhancement processing is carried out on an audio signal itself, the present invention may be applied as pitch enhancement processing for a linear predictive residual in a configuration that carries out linear prediction synthesis after carrying out the pitch enhancement processing on a linear predictive residual, such as described in Non-patent Literature 1. In other words, the present invention may be applied to a signal originating from an audio signal, such as a signal obtained by analyzing or processing an audio signal, as opposed to the audio signal itself.

The present invention is not limited to the foregoing embodiments and variations. For example, the various above-described instances of processing may be executed not only in chronological order as per the descriptions, but may also be executed in parallel or individually, depending on the processing performance of the device executing the processing, or as necessary. Other changes may be made as appropriate to the extent that they do not depart from the essential spirit of the present invention.

<Program and Recording Medium>

The various processing functions in the various devices described in the above embodiments and variations may be implemented by a computer. In this case, the processing details of the functions which each device should have are denoted in a program. By executing this program on the computer, the various processing functions of each of the devices, described above, are implemented on the computer.

The program denoting these processing details can be recorded on a computer-readable recording medium. The computer-readable recording medium may be any type of recording medium, such as a magnetic recording device, an optical disk, a magneto-optical recording medium, semiconductor memory, or the like.

This program is distributed by selling, transferring, or lending a portable recording medium, such as a DVD, a CD-ROM, or the like on which the program is recorded. Furthermore, this program may be distributed by storing the program in a storage device of a server computer and transferring the program from the server computer to other computers over a network.

The computer that executes such a program first temporarily stores the program recorded in the portable recording medium or the program transferred from the server computer in its own storage unit, for example. Then, when the processing is to be executed, the computer reads out the program stored in its own storage unit and executes the processing according to the read program. In another embodiment of the program, the computer may read out the program directly from a portable recording medium and execute the processing according to the program. Furthermore, the computer may execute the processing according to the received program sequentially whenever the program is transferred from the server computer to the computer. The configuration may be such that the above-described processing is executed by an ASP (Application Service Provider) type service, where the program is not transferred from the server computer to this computer, but the processing functions are realized only by instructing the execution and obtaining the results. Note that it is assumed that the program includes information provided for processing carried out by a computer and that is equivalent to the program (data or the like that is not direct commands to the computer but has properties that define the processing of the computer).

In addition, although each device is configured by having a predetermined program executed on a computer, at least part of these processing details may be implemented using hardware.

The invention claimed is:

1. A pitch emphasis apparatus that obtains an output signal by executing pitch enhancement processing on each of time segments of a signal originating from an input audio signal, the apparatus comprising:

a pitch enhancing unit that carries out the following as the pitch enhancement processing:

obtaining an output signal for each of times n in each of the time segments, the output signal being a signal including a signal obtained by adding (1) a signal obtained by multiplying the signal of a time further in the past than the time n by a number of samples $T_0$ corresponding to a pitch period of the time segment for the time n, $\eta$-th power of a pitch gain $\sigma_0$ of the time segment, and a predetermined constant $B_0$, to (2) the signal of the time n, $\eta$ being a value greater than 1.

2. The pitch emphasis apparatus according to claim 1, wherein the pitch enhancing unit carries out the following as the pitch enhancement processing:

obtaining an output signal for each of times n in each of the time segments, the output signal being a signal including a signal obtained by also adding, to the signal obtained by the adding, a signal obtained by multiplying a signal of a time further in the past than n by a number of samples $T_{-\alpha}$ corresponding to the pitch period of a time segment $\alpha$ time segments further in the past than the time segment for the time n, a pitch gain $\sigma_{-\alpha}$ of the time segment $\alpha$ time segments further in the past than the time segment for the time n, and a predetermined constant $B_{-\alpha}$.

3. The pitch emphasis apparatus according to claim 1, wherein the pitch enhancing unit carries out the following as the pitch enhancement processing:

obtaining an output signal for each of times n in each of the time segments, the output signal being a signal including a signal obtained by also adding, to the signal obtained by the adding, a signal obtained by multiplying a signal of a time further in the past than n by a number of samples $T_{-\alpha}$ corresponding to the pitch period of a time segment $\alpha$ time segments further in the past than the time segment for the time n, $\eta$-th power of a pitch gain $\sigma_{-\alpha}$of the time segment $\alpha$ time segments further in the past than the time segment for the time n, and a predetermined constant $B_{-\alpha}$.

4. A pitch emphasis method that obtains an output signal by executing pitch enhancement processing on each of time segments of a signal originating from an input audio signal, the method comprising:

a pitch enhancing step of carrying out the following as the pitch enhancement processing:

obtaining an output signal for each of times n in each of the time segments, the output signal being a signal including a signal obtained by adding (1) a signal obtained by multiplying the signal of a time further in the past than the time n by a number of samples $T_0$ corresponding to a pitch period of the time segment for the time n, $\eta$-th power of a pitch gain $\sigma_0$ of the time segment, and a predetermined constant $B_0$, to (2) the signal of the time n, $\eta$ being a value greater than 1.

5. A non-transitory computer-readable recording medium that records a program for causing a computer to function as the pitch emphasis apparatus according to claim 1.

* * * * *